US006050661A

United States Patent [19]

Fleisch

[11] Patent Number: 6,050,661

[45] Date of Patent: Apr. 18, 2000

[54] DRAWER

[75] Inventor: Walter Fleisch, Lustenau, Austria

[73] Assignee: Alfit Aktiengesellschaft, Götzis, Austria

[21] Appl. No.: 09/199,180

[22] Filed: Nov. 24, 1998

[30] Foreign Application Priority Data

Nov. 24, 1997 [AT] Austria ..... 1986/97

[51] Int. Cl.[7] ..... A47B 88/00

[52] U.S. Cl. ..... 312/348.1; 312/330.1; 312/265.5

[58] Field of Search ..... 312/330.1, 348.1, 312/348.2, 348.4, 263, 265.5, 265.6

[56] References Cited

U.S. PATENT DOCUMENTS

| | | | |
|---|---|---|---|
| 3,547,300 | 12/1970 | Studinski et al. | 312/263 X |
| 3,729,246 | 4/1973 | Harrell et al. | 312/348.2 |
| 4,099,815 | 7/1978 | Cox et al. | 312/348.2 |
| 4,173,379 | 11/1979 | Van Der Heiden et al. | 312/348.1 |
| 4,482,074 | 11/1984 | Lalley . | |
| 4,620,684 | 11/1986 | Delpercio et al. | 312/263 X |
| 5,538,339 | 7/1996 | Rock et al. | 312/348.2 X |
| 5,618,091 | 4/1997 | Huber et al. | 312/348.1 |
| 5,823,650 | 10/1998 | Lin | 312/348.2 X |

FOREIGN PATENT DOCUMENTS

| | | | |
|---|---|---|---|
| 400 999 | 10/1995 | Austria . | |
| 402 594 | 11/1996 | Austria . | |
| 402 595 | 11/1996 | Austria . | |
| 90 16 490 | 4/1991 | Germany . | |
| 93 11 435 | 11/1993 | Germany . | |
| 405317134 | 12/1993 | Japan | 312/348.4 |
| 327659 | 3/1958 | Switzerland | 312/348.4 |
| 1412723 | 7/1988 | U.S.S.R. | 312/348.1 |

*Primary Examiner*—Peter M. Cuomo
*Assistant Examiner*—Hanh V. Tran
*Attorney, Agent, or Firm*—Collard & Roe, P.C.

[57] ABSTRACT

In a drawer with side frames (1) and a rear wall (2) made of sheet metal, the lower ends of the side frames (1) and the rear wall (2) are provided with flanges (4) or bevels (5) designed like longitudinal grooves for holding a drawer bottom (3). At the rear ends of the frames (1) inwardly facing bevels (8) are provided for supporting the rear wall (2), and the rear wall (2) can be fixed at these bevels by flat engagement hooks (15) formed on said rear wall, where the engagement hooks (15) engage in slots (9) of the bevels (8), and at a distance below the engagement hook (15) a flat securing lug (16) is provided, which can be introduced into a further slotted opening (10) of the bevel (8) of the side frame (1). To achieve a stable and easily mountable construction, the rear wall (2) has an upwardly directed engagement hook (15) for each of the two bevels (8) of the side frames (1), which engagement hook can be put through an associated slotted opening (9), which ends at a distance from the upper edge of the bevel (8), and snaps onto the upper end of this slotted opening.

1 Claim, 2 Drawing Sheets

DRAWER

1. Field of the Invention

This invention relates to a drawer comprising side frames and a rear wall made of sheet metal, wherein the lower ends of the side frames and the rear wall are provided with flanges or bevels designed like longitudinal grooves for holding a drawer bottom, at the rear ends of the frame inwardly facing bevels are provided for supporting the rear wall, and the rear wall can be fixed at these bevels by means of flat engagement hooks formed on said rear wall, where the engagement hooks engage in slots of the bevels and at a distance below the hook a flat securing lug is provided, which can be introduced into a further slotted opening of the bevel of the side frame.

2. Description of the Prior Art

Such drawer is known from U.S. Pat. No. 5,538,339. The fundamental advantage of such construction consists in that the rear wall can be prefabricated corresponding to the respective, mostly standardized drawer width, and can be connected with the side frames without use of tools or additional fastening means. As compared to known drawer constructions, where the rear wall is cut out from a plate and is fixed by means of screws introduced through holes in the side frames, there is thus achieved a substantial simplification of manufacture and assembly, and in addition the bottom portion of the drawer is also supported in the bevel of the rear wall, which is designed like a longitudinal groove, where this bottom at the same time secures the rear wall in the mounting position. The securing lug supports the rear wall at the proper height before mounting the bottom portion and serves for an additional transmission of the weight load to the frame.

In the known construction, the engagement hook on every rear wall side proceeds from the upper edge portion of this rear wall, is directed downwards and engages in a slot in the bevel of the frame, which is open towards the top. To achieve a uniform height of the upper edge portion of frame and rear wall, the upper edge of the bevel must be cut out deeper. Directly beside the bevel and quite close to the upper edge of the side frame there is mostly fixed a roller of a drawer guideway, which due to the above-mentioned cutout and in particular due to the open slot in the bevel is especially held in the weakened portion of the frame, but must nevertheless take its share of the weight of drawer and drawer contents, so that in the case of higher loads there is a risk of deformations of the frame, and accordingly, because of the change in the axial position of the roller, the actuation of the drawer is impeded or rendered difficult, the drawer can no longer be closed properly, unpleasant running sounds are produced, and the frame might even come off in the vicinity of the fixation of the roller.

Similar known constructions according to AT 402 595 B and DE 90 16 490 U1 have the same disadvantages, where a clevis-type mounting of the rear wall is achieved in that the upper edge of this rear wall is bent in a U-shaped manner, so that it can snap on the upper edge of the two bevels of the side frames, which has correspondingly been cut out deeper. According to the above-mentioned AT 402 595 B, the bevel beside the deepened cutout of the frame is provided with a tongue protruding upwards, which for additionally securing the connection engages in a plug-in opening of the bent upper edge of the rear wall.

SUMMARY OF THE INVENTION

It is the object of the invention to create a drawer as described above, wherein a weakening of the side frames in the rear upper end portion mostly designed for mounting a roller is avoided, the manufacture of the rear wall of the drawer is simplified, and the assembly on the whole is facilitated.

This object is solved in that the rear wall for each of the two bevels of the side frames has an upwardly directed engagement hook, which can be put through an associated slotted opening, which ends at a distance from the upper edge of the bevel, and snaps onto the upper end of said slotted opening, where preferably the engagement hooks and securing lugs protrude from embossed stiffening portions in the edge portion of side flanges bevelled from the side wall of the drawer to the rear and the outside.

Engagement hooks and slotted opening can be mounted with a sufficient distance from the upper edge of the rear wall or the frame, and it is not necessary to cut out the frame at the top in the vicinity of the bevel, so that the strength of this frame near the mounting point of a roller is not reduced. The rear wall can be manufactured in one embossing and shaping step together with the hook and the securing lug. It is also possible to mount with a distance only one hook and instead two or more securing lugs for each rear wall side, in order to improve the support.

Due to the side flanges and a mostly provided upper web facing towards the same side as well as due to the bevel designed like a longitudinal groove for accommodating the drawer bottom, the rear wall as such receives a sufficient reinforcement, so that it can be manufactured from relatively thin sheet metal, where due to the preferred embodiment of the subject-matter of the invention with embossed stiffening portions for the mounting area of the engagement hooks and the securing lugs, the necessary strength is also achieved for these points exposed to a higher load.

A further increase in strength can be achieved in that the embossed stiffening portions of the side flanges for the engagement hooks proceed from the upper edge portion of the side flanges, and an upper web likewise bevelled out of the rear wall of the drawer has a stiffening tongue exposed by one longitudinal notch each and to be bent from the top into the associated embossed portion.

BRIEF DESCRIPTION OF THE DRAWING

Further details and advantages of the subject-matter of the invention can be taken from the subsequent description of the drawing.

In the drawing, the subject-matter of the invention is illustrated by way of example, wherein.

DESCRIPTION OF THE PREFERRED EMBODIMENTS

Figure 2:
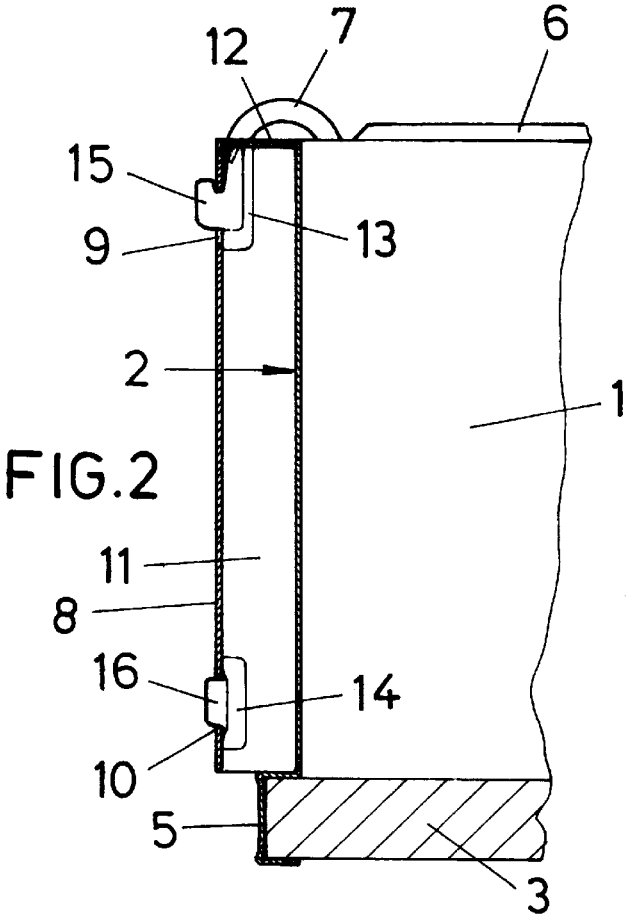
FIG. 2 illustrates a longitudinal section through a drawer in the area of engagement of hook and securing lug.
Figure 4:
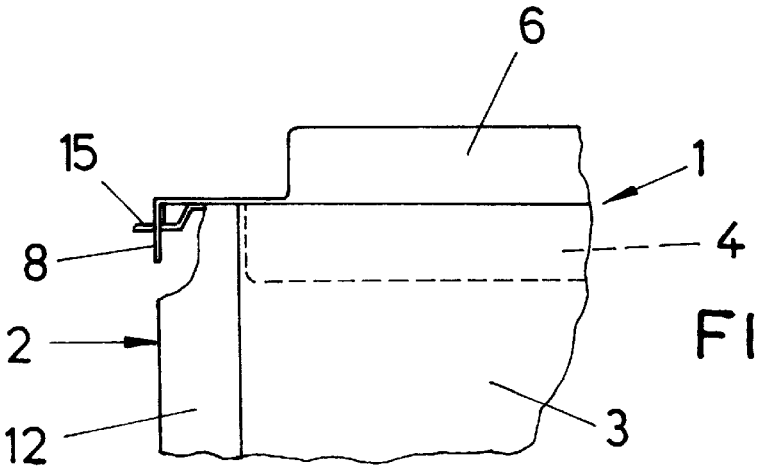
FIG. 4 illustrates a top view of FIG. 2.

Of a drawer, FIGS. 2 and 4 illustrate a side frame 1, the rear wall 2 of the drawer and a drawer bottom 3. The side frame 1 (to which corresponds a diametrically opposed frame disposed on the other side of the drawer) is designed as shaped sheet metal part, just as the rear wall 2 of the drawer. At their lower ends, both the side frame 1 and the rear wall 2 are provided with bevels 4, 5, which for the side frame 1 are designed as flange 4, and for the rear wall 2 are designed as longitudinal groove and support or accommodate the edge of the frame bottom 3. At its upper end, the side frame 1 has an outwardly protruding flange 6, which normally serves as guideway for the roller of a stationary guide rail fixed at the carcass side wall of a piece of furniture. A roller 7 running on this stationary guide rail was only illustrated in FIG. 2 and is held in the upper rear end portion of the frame 1. At the rear end of the frame 1 an inwardly directed bevel 8 is provided, in which two slotted openings 9, 10 are disposed, where the upper slotted opening 9 ends at a distance from the upper edge of the bevel 8.

Figure 1:
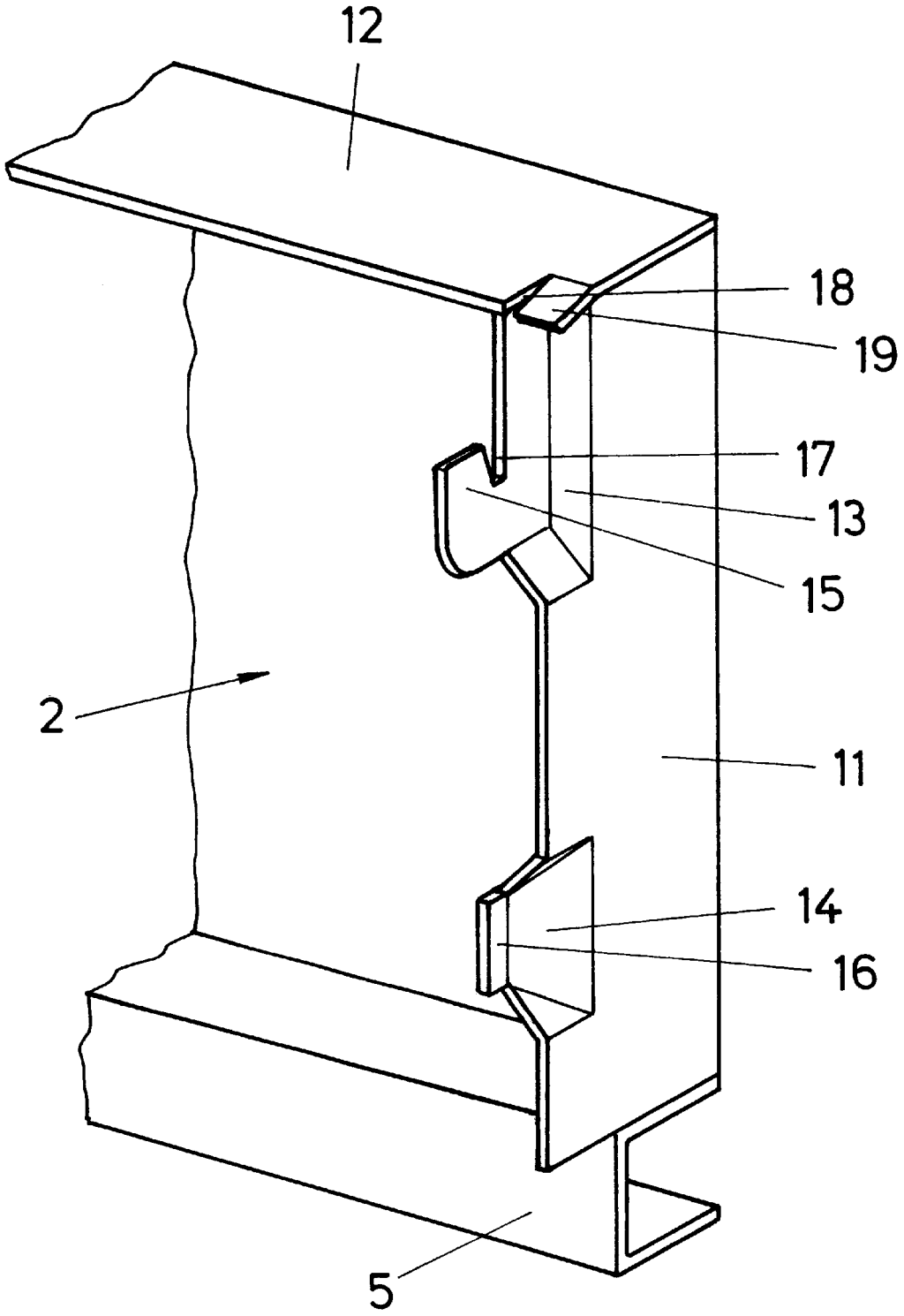
FIG. 1 schematically illustrates the right portion of the rear wall of a drawer.

According to FIGS. 1, 2 and 4, side flanges 11 and an upper web 12 are bevelled to the rear and the outside from the rear wall 2 of the drawer, and the side flanges 11 are provided with embossed portions 13, 14, from which protrude an upwardly directed engagement hook 15 and a securing lug 16, respectively. The hook opening 17 is downwardly tapered. From the upper web 12 there is furthermore formed a stiffening tongue 19 exposed by a longitudinal notch 18, which tongue can be bent from the top into the embossed portion 13, from which protrudes the engagement hook 15, so that it produces a connection between side flange 11 and web 12.

With its engagement hooks 15, the rear wall 2 is hung into the slotted openings 9 of the bevels 8 and is then flapped against the bevels 8 from the inside, so that the securing lugs 16 move into the slotted openings 10. Subsequently, the drawer bottom 3 is placed on the flange 4 or in the bevel 5, so that the rear wall 2 is also secured in its position by the bottom 3.

Figure 3:
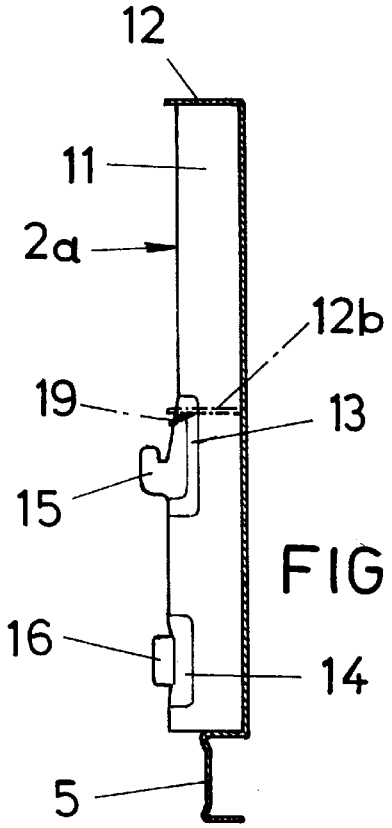
FIG. 3 illustrates a longitudinal section through a variant of the rear wall of the drawer.

The rear wall 2 shown in FIGS. 1, 2 and 4 is designed for a drawer, where the side frames 1 approximately have the same height as the rear wall 2. In FIG. 3, a drawer is represented in full lines, where the side frames 1 are lower than the rear wall 2*a*, in order to mount a railing above the side frames 1. The embossed portion 13 with the engagement hooks 15 is mounted deeper corresponding to the frame height. In the case of a drawer without railing, the rear wall must be made lower by the height of the railing with the same frame height, as this is indicated in dash-dotted lines by the bevel 12*b*.

I claim:

1. A drawer comprising two side frames and a rear wall of sheet metal, the rear wall having two ends adjacent the side frames, a first flange extending inwardly from a rear end of each side frame, a second flange extending rearwardly from each rear wall end, each second flange having embossed stiffening portions projecting from an edge of the second flange, one of the embossed stiffening portions extending from an upper edge of the second flange and including a flat, upwardly directed engagement hook and another one of the embossed stiffening portions including a securing lug, and each first flange defining an upper slot spaced from an upper edge of the first flange and arranged to receive the engagement hook and a lower slot spaced from the upper slot, the lower slot being arranged to receive the securing lug, and a third flange extending rearwardly from an upper edge of the rear wall, the third flange being notched to form a stiffening tongue being bent into the one embossed stiffening portion protecting from the edge of the second flange.

* * * * *